US005580220A

United States Patent [19]

Baumann

[11] Patent Number: 5,580,220

[45] Date of Patent: Dec. 3, 1996

[54] FAN GUARD APPARATUS

[75] Inventor: John Baumann, Islip, N.Y.

[73] Assignee: Uniwave, Inc., Farmingdale, N.Y.

[21] Appl. No.: 503,996

[22] Filed: Jul. 19, 1995

[51] Int. Cl.[6] ..... F04D 29/70

[52] U.S. Cl. ..... 416/247 R; 415/121.2

[58] Field of Search ..... 416/247 R; 415/121.2, 415/208.2, 208.3

[56] References Cited

U.S. PATENT DOCUMENTS

| | | | |
|---|---|---|---|
| 515,405 | 2/1894 | Meston | 416/247 |
| 2,262,854 | 11/1941 | Morris | 415/208.1 X |
| 2,620,127 | 12/1952 | Radcliffe | 416/247 |
| 3,173,478 | 3/1965 | Maycen | 416/247 |
| 3,261,544 | 7/1966 | Guichard | 416/247 R X |

FOREIGN PATENT DOCUMENTS

| | | | |
|---|---|---|---|
| 2500703 | 7/1976 | Germany | 416/247 R |

*Primary Examiner*—Edward K. Look
*Assistant Examiner*—Michael S. Lee
*Attorney, Agent, or Firm*—Schweitzer Cornman & Gross

[57] ABSTRACT

A fan guard for use in connection with a textile fan blower is of minimal surface area to intrude upon the air flow or collect lint or debris. The guard has a plurality of fingers joined together by a mounting ring. The fingers are annexed in a spoke-like configuration to embrace the fan blades, and are free of additional interconnections along their length. The ends of the fingers are located so as to create an open central exhaust corridor for the fan.

4 Claims, 2 Drawing Sheets

10
12
14
16
16
18
20
22
24
26
28
30
30
32
32
34
34
36
38
38
40
42
42

FAN GUARD APPARATUS present invention relates to a new and improved fan guard for use in connection with blower units typically intended for installation in knitting mills and the like.

BACKGROUND OF THE INVENTION

The use of fans or blowers to assist in the removal of dust, lint and debris from industrial knitting machines is well known, as exemplified by U.S. Pat. Nos. 5,412,090 to Baumann; 5,175,905 to Gutschmit; 3,072,321 to King, Jr.; and 2,063,874 to Hodge. Such blowers develop a stream of air which is directed at the equipment to be cleaned. The flow of air drives accumulated lint, dust and other debris from the equipment surfaces, thus contributing to continued maintenance-free operation.

The rotating blades of the fan units present a potential hazard to the personnel in proximity to the machinery with which the fans are operating. In addition to the rotating fan blades being able to inflict injury upon contact with an individual, the blades also provide a potential risk to tools and equipment which, either through the carelessness or inattention of a user, interfere with blade rotation.

A blade guard assembly may be used to minimize the risk of contact between the rotating fan blades and other objects. Conventional fan guards, however, introduce additional problems and concerns. Because they are by necessity located close to the fan blades, they typically become a resting place for lint and debris drawn from the ambient atmosphere through the fan blades and carried therefrom by the created air flow. This debris, if allowed to collect on the fan guard, decreases the efficiency of the fan by blocking the air flow. It also often becomes dislodged from the guard in clumps or aggregates, and is then blown by the fan towards the very surfaces which the fan air wash is supposed to clean. In addition, the fan guard itself serves as a block to the air flow. The denser the guard, the greater its intrusion upon the air flow.

It is accordingly a purpose of the present invention to provide a fan guard which minimally intrudes upon the fan air flow.

Another purpose of the present invention is to provide a fan guard which minimizes the surface area upon which lint and other debris can collect.

Still another purpose of the present invention is to provide a fan guard having the previous attributes which may be of economical manufacture, and which may be simply installed upon, and used with, conventional fan units.

SUMMARY OF THE INVENTION

In accordance with the foregoing and other purposes and objects, a fan guard of the present invention comprises a plurality of finger-like elements projecting radially outward from a support structure, preferably of a ring-like configuration, which is mountable to a fan motor housing. Each of the fingers may include a pair of linear portions surrounding a central arcuate portion which surrounds the included volume generated by at least the tips of the rotating fan blades. The distal ends of the fingers are free, providing a resiliency to the individual fingers, defining a central guard-free air corridor for the generated air flow, and which further maximizes the arm-free surface area surrounding the fan blades to minimize intrusion upon air flow through the guard.

BRIEF DESCRIPTION OF THE DRAWINGS

A fuller understanding of the present invention may be achieved upon consideration of the following detailed description of a preferred, but nonetheless illustrative embodiment of the invention, when considered in association with the annexed drawings, wherein.

DETAILED DESCRIPTION OF THE INVENTION

Figure 1:
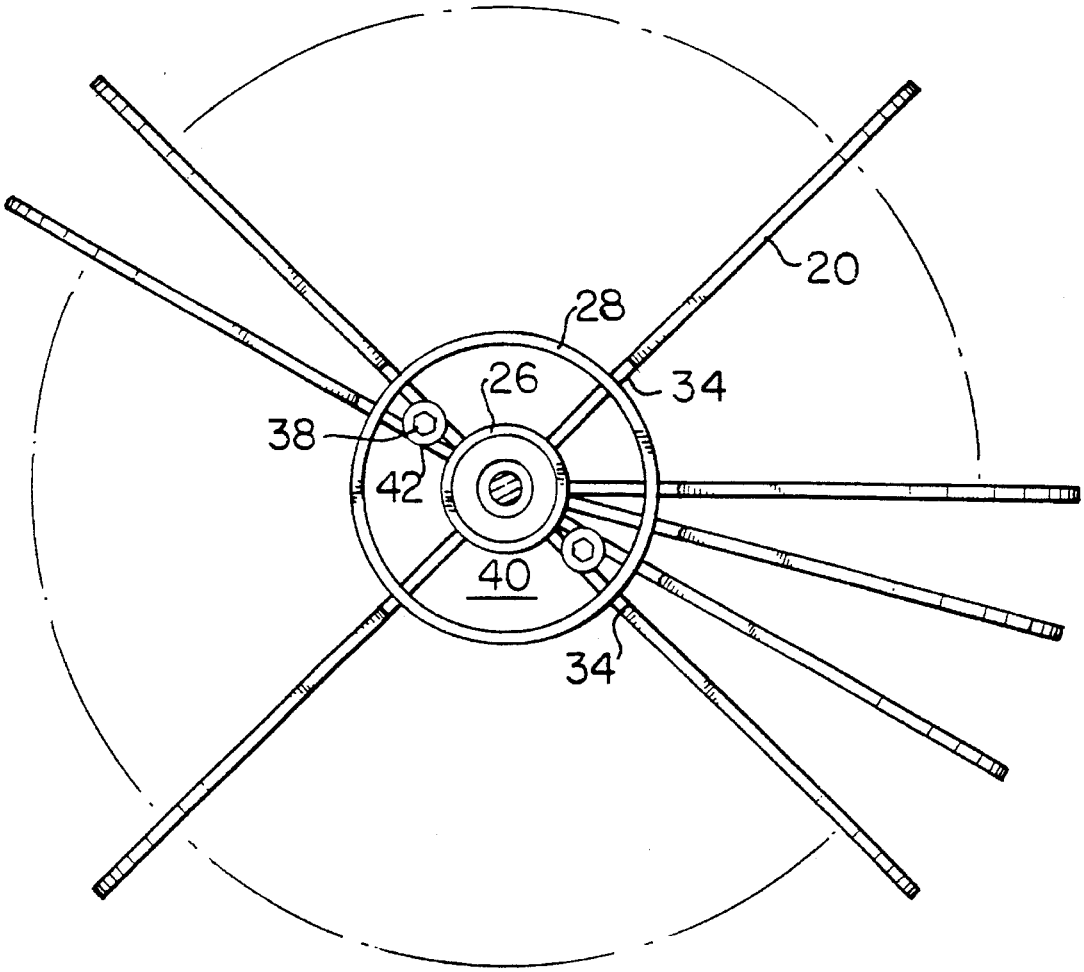
FIG. 1 is a bottom plan view of a fan guard of the present invention installed on a typical fan motor showing a representative number, but not all, of the fingers.

With reference to the Figures, lint-removing fan blower unit 10 includes fan motor 12 having shaft 14 to which fan blades 16 are fixed. The fan blower 10 is typically mounted to a support arm (not shown) either directly or through a drive system which allows the fan blower to rotate or revolve about one or more axes to allow the air blast developed by the fan blades 16 to wash across the targeted equipment surfaces.

The fan guard 18 of the present invention consists of a plurality of fingers 20 arranged in a generally spoke-like configuration to surround the fan blades 16. In a typical arrangement, the fingers are 24 in number, spaced radially at 15 degree intervals. Each of the fingers 20 may include a generally linear proximal portion 22, the terminal end portions 24 of which being joined to a pair of concentric mounting rings 26, 28. The smaller or inner ring 26 may be located at the end of the fingers, while the outer ring 28 may be spaced from the inner ring about one inch. The fingers 20 are welded or otherwise joined to the rings.

Each of the fingers further includes a central, arcuate portion 30, joined to a distal linear portion 32 terminating in a free finger end 34. As may be seen in FIG. 2, the arcuate portion may generally conform to the shape of the outer portion of the fan blades 16, while the distal end 34 of the finger is so located as to be clear of a central exhaust air corridor 36. The fan guard may be mounted to the motor housing by a series of bolts 38 engaging complimentary threaded bores in the motor housing face 40. The bolts 38 may be provided with washers 42 to engage adjacent pairs of guard fingers 20, retaining the guard assembly in contact with the motor housing.

Figure 2:
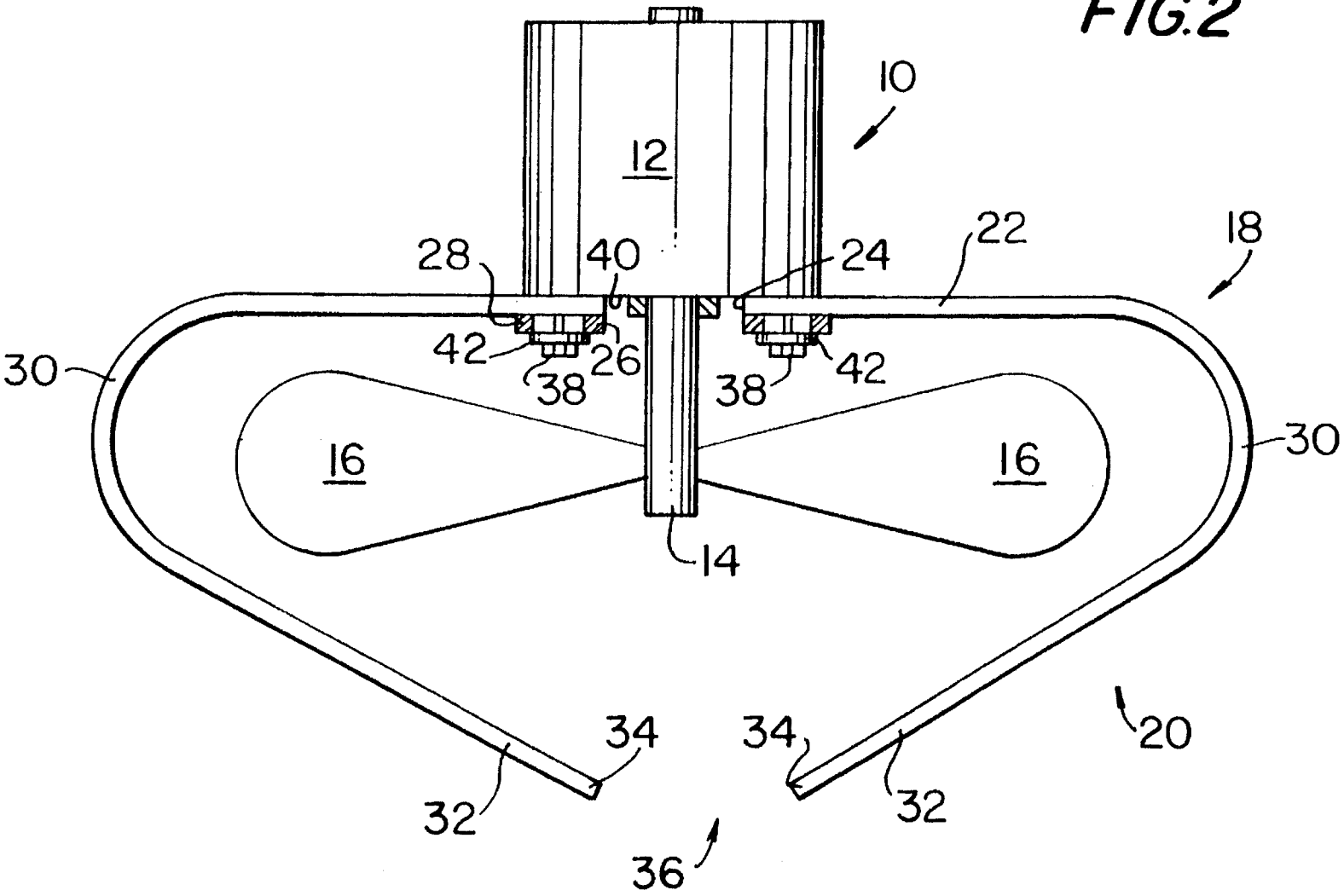
FIG. 2 is an elevation view thereof.

In association with a typical fan blower 10 having a 10 inch diameter blade assembly, the first proximal portion 22 of the arms may be approximately 3 inches, the arcuate portion having a two-inch radius and terminating at a point whereby the distal linear portion 32 defines a 45 degree angle from the horizontal as seen in FIG. 2. The central corridor or passageway 36 defined by the distal ends 34 of the fingers is generally circular, and may have a radius of approximately 2.2 inches. Both the fingers 20 as well as the mounting rings 26, 28 may be formed of ⅛ inch diameter steel wire.

So constructed, the fan guard of the present invention provides protection against inadvertent contact against the rotating fan blades, particularly at the tips thereof, which attain the greatest linear velocity and which are most likely to cause injury. Because the fingers are joined together only by the mounting rings 26, 28, which are located at the motor and thus do not provide additional obstruction to air flow, the overall surface area of the fan guard presented to air flow, is minimized. Such minimization is further accomplished by termination of the individual arms at the distal ends 34, forming the obstruction-free central corridor 36 for the exiting air flow. Further, as each of the fingers is free of connections to its neighbors along its length, in the event of inadvertent contact, the flexibility provided thereby can limit injury or damage resulting from such contact. Air flow is maximized through the fan guard, and the provision of a minimal amount of interfering surfaces, devoid of interconnections, joints or fittings where lint and debris can accumulate, allows for the continued operation of a fan so equipped without the necessity for periodic cleaning and lint removal which is required with conventional fan guard systems.

I claim:

1. A fan guard for use in connection with a textile fan blower unit having a motor and a fan blade unit mounted thereto, comprising a plurality of fingers, each of said fingers having first and second ends bounding a first linear portion, an arcuate intermediate portion, and a downwardly-sloped linear distal portion terminating in said second end, said fingers being arranged in a spoke-like manner with the first ends proximate said motor shaft, said fingers each being of an extended length to partially surround and be spaced from said blades, the distal ends of said fingers being free and define a central, generally circular central exhaust air corridor; and a pair of concentric mounting means affixed to said first ends of said fingers and adapted to mount upon a face of a housing for said motor for connecting the fan guard to said fan blower unit.

2. A fan guard for use in connection with a textile fan blower unit having a motor and a fan blade unit mounted thereto, comprising a plurality of fingers, each of said fingers having first and second ends, said fingers being arranged in a spoke-like manner with the first ends proximate said motor shaft, said fingers each being of an extended length to partially surround and be spaced from said blades, each of the distal ends of said fingers being free and defining a central, generally circular central exhaust air corridor, each of said fingers including a first portion, an arcuate intermediate portion, and a downwardly-sloped distal portion terminating in said distal finger end, and mounting means located at said first ends of said fingers for connecting the fan guard to said fan blower unit.

3. The fan guard of claim 2, wherein said mounting means comprise a pair of concentric mounting rings affixed to said finger first ends.

4. The fan guard of claim 3, wherein said mounting rings are adapted to further mount upon a face of a housing for said motor.

* * * * *